US005281016A

United States Patent [19]

Brague

[11] Patent Number: 5,281,016

[45] Date of Patent: Jan. 25, 1994

[54] COLLAPSIBLE, PORTABLE CABINET

[75] Inventor: Allan R. Brague, Winona, Minn.

[73] Assignee: L. B. White Co., Inc., Onalaska, Wis.

[21] Appl. No.: 822,000

[22] Filed: Jan. 15, 1992

[51] Int. Cl.[5] ..... A47B 43/00

[52] U.S. Cl. ..... 312/140.2; 312/258; 312/290; 312/249.8

[58] Field of Search ..... 312/140.2, 140.4, 258, 312/290, 249.8, 249.11, 293.2, 328, 351.11, 240

[56] References Cited

U.S. PATENT DOCUMENTS

| | | | |
|---|---|---|---|
| 150,784 | 5/1874 | Pierson | 312/258 |
| 2,488,035 | 11/1949 | Pistone | 312/290 |
| 2,813,769 | 11/1957 | Post | 312/258 |
| 3,027,216 | 3/1962 | Van Alstyne | 312/290 |
| 3,288,545 | 11/1966 | Benne | 312/290 |
| 4,437,714 | 3/1984 | Struck | 312/290 |
| 4,579,401 | 4/1986 | Mears | 312/258 |

*Primary Examiner*—Peter M. Cuomo
*Assistant Examiner*—Flemming Saether
*Attorney, Agent, or Firm*—Fredrikson & Byron

[57] ABSTRACT

An apparatus for use as a portable cabinet. The apparatus is comprised of a lower section (11) with a first end (12), a second end (13), a front portion (14), and a bottom portion (15), that is attached to an upper section (16) with a first end (17), a second end (18), a front portion (19) and a top portion (20) by a hinging element (24). The upper section (16) is arranged and configured to allow it to fold into the lower section (11) creating open and closed positions. The apparatus further comprises a securing element (39) to support the upper section (16) when in the open position and elements to improve the mobility of the apparatus.

23 Claims, 4 Drawing Sheets

COLLAPSIBLE, PORTABLE CABINET

FIELD OF INVENTION

This invention relates to portable cabinets, and more particularly to portable cabinets that can be easily folded into a smaller size to improve their transportability or storage.

BACKGROUND OF INVENTION

Many catering businesses and establishments that are rented for parties utilize portable cabinets as bars or serving stations. Unfortunately, these portable cabinets are large and bulky making their transportation difficult. In addition, if they are kept on site, they require large storage areas. Therefore, there arises the need for a portable cabinet that is large enough to act as a bar or serving station, but yet small enough for transportation and storage purposes.

The present invention meets this need with a cabinet that is foldable. The invention has an upper section that is hinged to a lower section allowing the upper section to fold into the lower section, reducing the size of the cabinet for transportation or storage. The cabinet can also be equipped with rollers or handles to improve transportation and can be stored vertically for closet and small floor space storage.

BRIEF SUMMARY OF INVENTION

The present invention is for an apparatus for use as a portable cabinet. The invention is made of an upper section and a lower section hinged together allowing the upper section to fold into the lower section. This hinged design enables one to quickly transfer the unit from an open position to a closed position without removing parts.

In the open position, the invention is large enough to be capable of operating as a portable bar or serving station. In the closed position, it is small enough to be stored in out-of-the-way, low headroom areas. In addition, the invention can also be stored vertically on its side for storage in closets or small floor space areas.

The invention is also equipped with a rolling means on the bottom of the cabinet and a handle on one side to improve the mobility of the cabinet. When the end of the cabinet with the handle is elevated, the cabinet can be pushed or pulled as if it were a cart. The smaller closed position and cart-like movement provide for improved mobility in doorways or around corners that conventional portable cabinets are lacking.

In one embodiment, the invention is comprised of a lower section having two ends and a front and bottom portion; an upper section having two ends with heights generally less than or equal to the width of the lower section ends, and a front portion having a compatible size and shape with the lower section bottom portion, and a top portion having a compatible size and shape with the lower section front portion; a hinging means for pivotably attaching the bottom of the upper section front portion to the top of the lower section front portion enabling the upper section to move from an open to closed position; a supporting means for securing the upper section to the lower section when the cabinet is in the open position; and a hauling means attached to either the upper section or lower section.

Alternate embodiments of the invention could also include a locking device to secure the cabinet while it is in the closed position or the use of bumpers on one side of the unit to prevent damage during storing in the vertical position.

The present invention is further explained hereinafter with more particularity and by reference to the preferred embodiment shown in the following drawings.

DETAILED DESCRIPTION OF THE PREFERRED EMBODIMENT

Figure 1:
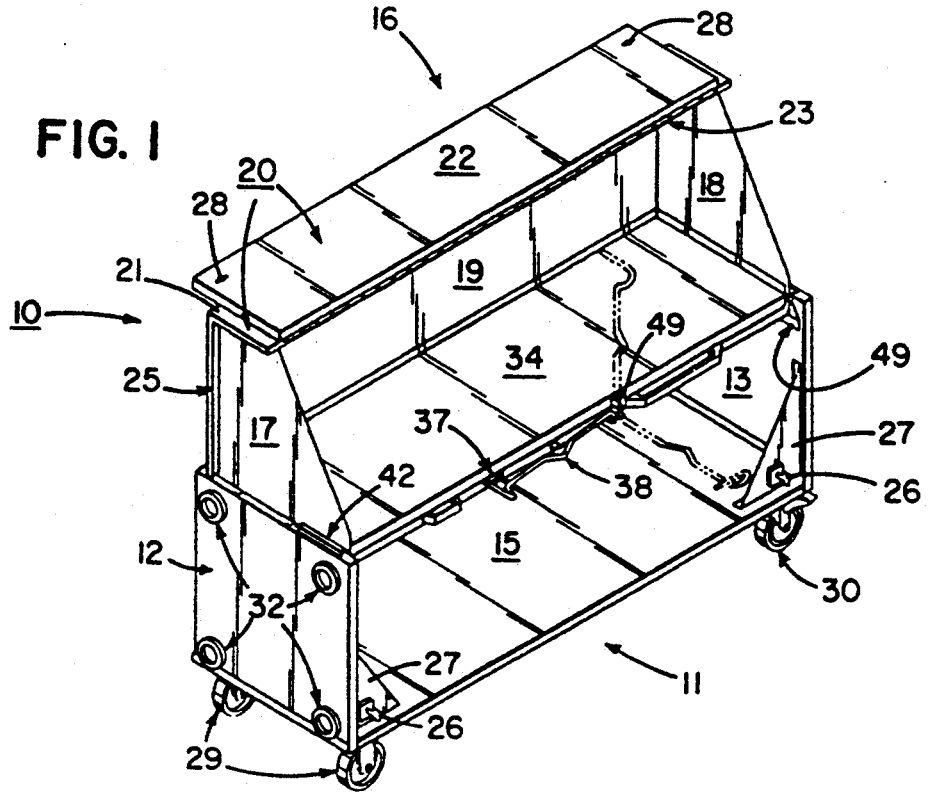
FIG. 1 is a perspective view of the preferred embodiment of the invention in the open position.

Referring to the drawings wherein like numerals designate like parts, the preferred embodiment of the invention is a cabinet, generally designated as 10, comprised of an upper section 16 and a lower section 11, FIG. 1. The lower section 11 has a front portion 14 operatively connected to a bottom portion 15, a first end portion 12 and a second end portion 13 by a suitable means comprised of carriage bolts and locking nuts with nylon inserts, those skilled in the art would appreciate that other means are available. The upper section 16 is comprised of a front portion 19 operatively connected to a first end portion 17, a second end portion 18 and a top portion 20 by a suitable means comprised of carriage bolts and locking nuts with nylon inserts, those skilled in the art would appreciate that other means are available.

The upper section top portion 20 is further comprised of a fixed portion 21 and a flap portion 22. The fixed portion 21 and flap portion 22 are attached by a hinge 23 to allow the flap portion 22 to fold over the fixed portion 21 to act as a service counter.

Figure 3:
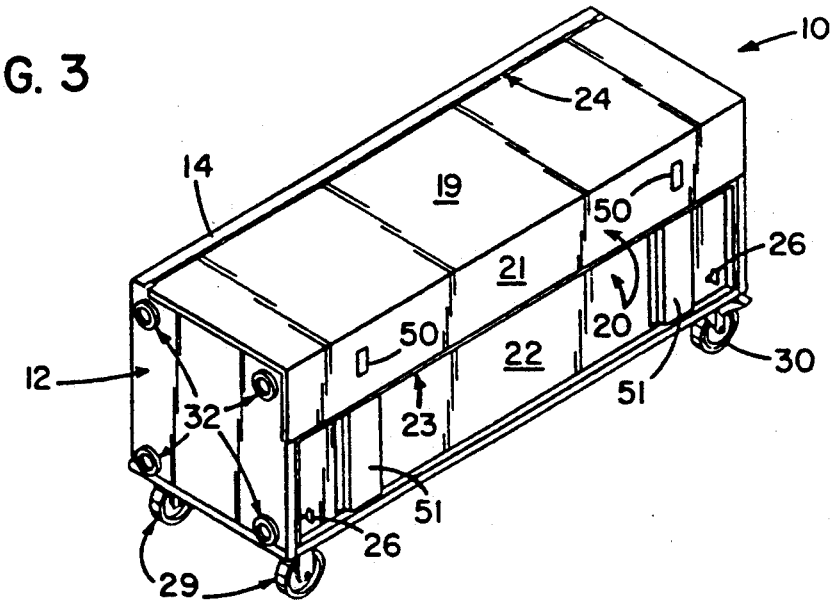
FIG. 3 is a perspective view of the preferred embodiment shown in FIG. 1 in a closed position and showing a horizontal storage position.

To enable the cabinet 10 to move between the opened and closed position, a piano-type hinge 24, as shown in FIG. 3, is used to connect the upper section front portion 19 to the lower section front portion 14.

Figure 2:
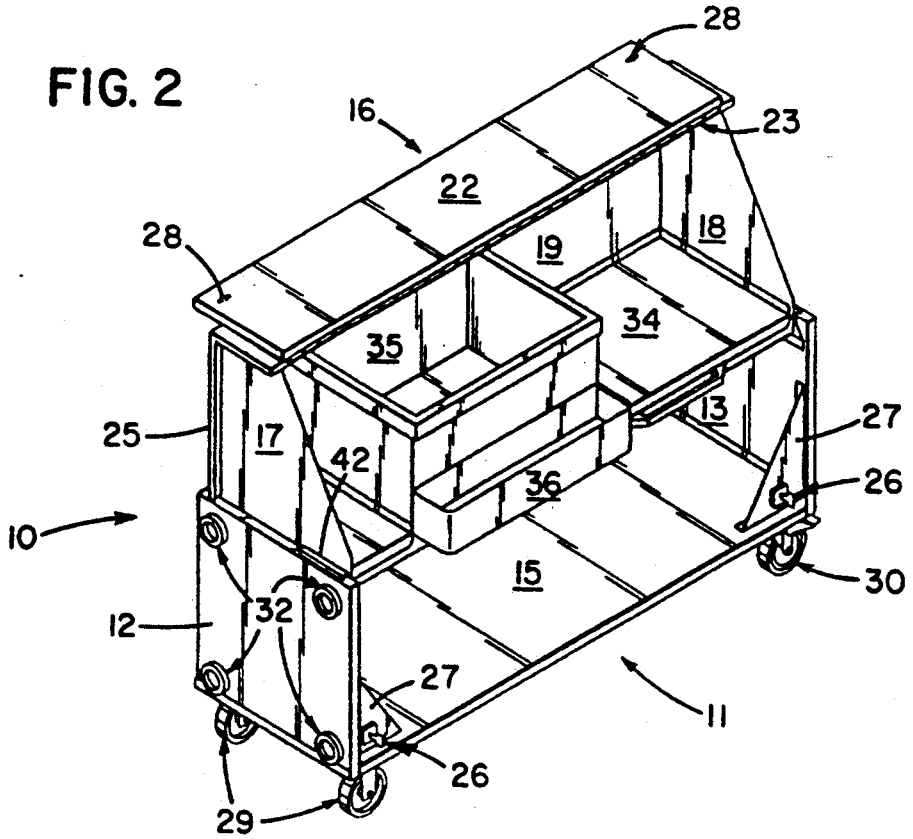
FIG. 2 is a perspective view of an alternative embodiment of the invention in the open position.

As shown in FIG. 1, a shelf 34 is also attached to and generally located at the bottom of upper section front portion 19 and upper section first and second end portions 17, 18. An alternative embodiment of the invention, FIG. 2, further comprises a shelf 34 with an integrated insulated bin 35 that can be used for holding ice when the cabinet 10 is used as a portable bar. This embodiment also comprises a means for attaching a speedrail 36 to the insulated bin 35 when used as a portable bar.

The alternative embodiment incorporates two attachment means for securing the speedrail 36 to the insulated bin 35. The first is used when the cabinet 10 is in the open position. The speedrail 36 would incorporate three keyhole apertures spaced in a horizontal line near the top of the side of the speedrail 36 that will be adjacent to the insulated bin 35. The insulated bin 35 would have three pins arranged and configured near the bottom of the side that faces the back of the cabinet 10 to fit into the keyhole apertures, thereby securing the speedrail 36 to the insulated bin 35 when the cabinet 10 is in the open position.

The second attachment means would be used to attach the speedrail 36 to the insulated bin 35 when the cabinet 10 will be in the closed position. A latch is attached to each of two opposite sides of and located near the top of the insulated bin 35. A matching latch attachment would be located on corresponding sides of the speedrail 36 whereby the speedrail 36 can be secured to the top of the insulated bin 35 when the cabinet 10 is to be in its closed position. Those skilled in the art would appreciate that other means could be used to secure the speedrail 36 to the insulated bin 35 when the cabinet 10 is in either the open or closed position.

The preferred embodiment would use 0.10 thick aluminum with 8 mil vinyl metal laminate for materials on the upper section 16 and lower section 11. The exterior would have a walnut finish and the interior would have a black matte finish although other optional colors may be used.

The size and shape of the upper section 16 and the lower section 11 must be compatible or the upper section 16 will not be able to fold into the lower section 11. Therefore, the preferred embodiment has a shelf 34 with a length that is less than the length of the space defined between the lower section first and second ends 12, 13. The shelf 34 also has a width that is less than the height of the lower section front portion 14.

Figure 7:
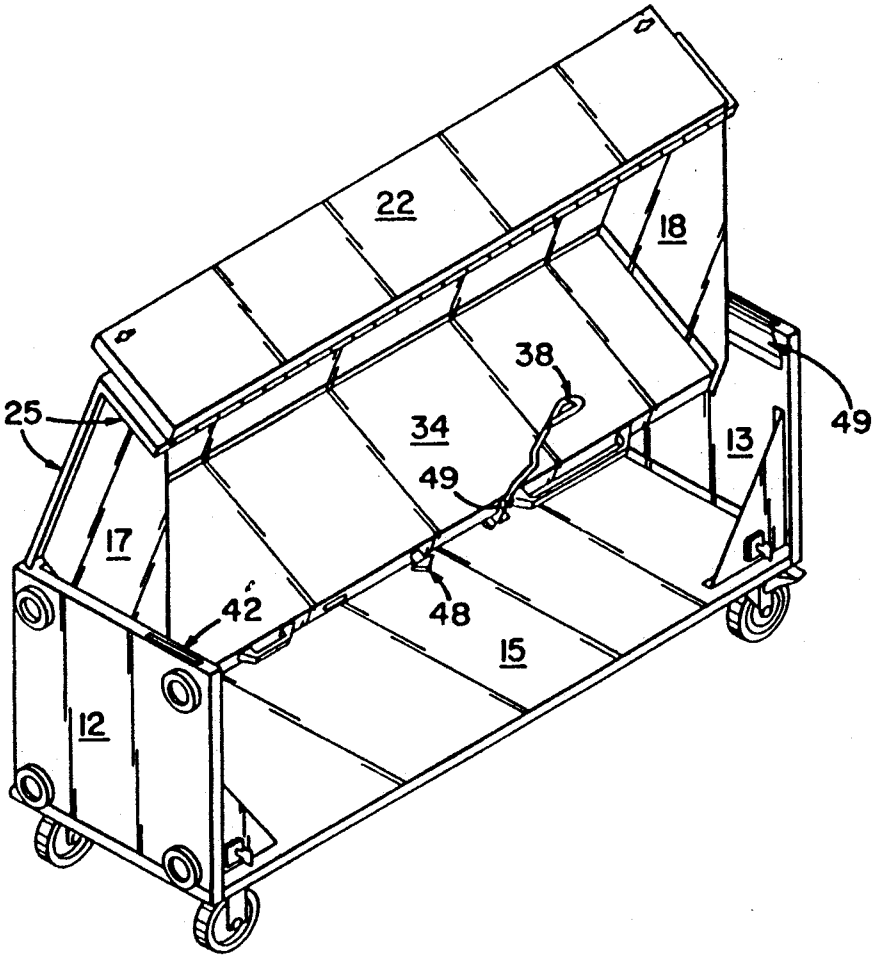
FIG. 7 is a perspective view of the preferred embodiment shown in FIG. 1 between the open and closed positions.

Similarly, upper section first and second end portions 17, 18 have a width that is less than the height of the lower section front portion 14. In addition, upper section first and second end portions 17, 18 are spaced at a distance that is less than the length of the space defined between the lower section first and second end portions 12, 13 to allow the shelf 34 and upper section first and second end portions 17, 18 to fold into the lower section 11, as best shown in FIG. 7.

Upper section front portion 19 and fixed portion 21 of upper section top portion 20 are sized to be equal in length to the distance between the outside edge of lower section first end portion 12 and the outside edge of lower section second end portion 13 to enable upper section front portion 19 and fixed portion 21 to rest on lower section first and second end portions 12, 13 when the cabinet 10 is in its closed position, as shown in FIG. 3. Upper section front portion 19 and fixed portion 21 also comprise a terminal flange 25 extending from each end of the upper section front portion 19 and fixed portion 21 at a right angle and toward the lower section first and second ends 12, 13, whereby they partially extend over the outside surface of lower section first and second ends 12, 13 when the cabinet 10 is in the closed position, FIG. 3.

The flap portion 22 of upper section top portion 20 is generally equal in length to the space defined between lower section first and second end portions 12, 13, FIG. 1. As shown in FIG. 3, its height is sized to be equal to the distance between the upper section top fixed portion 21 and the lower section bottom portion 15 when the cabinet 10 is in the closed position.

The preferred embodiment is also equipped with a locking means to secure the cabinet 10 while in the closed position. While many locking means could be used, the preferred embodiment comprises two rotating flanges 26 having a width greater than their thickness that are mounted on separate triangular braces 27, FIG. 1. One brace 27 is attached to lower section first end portion 12 and lower section bottom portion 15 while the second brace is attached to lower section second end portion 13 and lower section bottom portion 15 so that the rotating flanges 26 extend out toward the back of the cabinet. The flap portion 22 of the upper section 16 has apertures 28 with similar widths and thicknesses as the rotating flanges 26 that are generally located to align with the rotating flanges 26 when the cabinet 10 is in the closed position.

To lock the cabinet 10, the upper section 16 is folded into the lower section 11. Then the rotating flanges 26 are turned to align with the apertures in the flap portion 22. The flap portion 22 is then closed over the rotating flanges 26 and the rotating flanges 26 are turned ninety degrees to lock the cabinet 10 as shown in FIG. 3.

The preferred embodiment also comprises a lifting bar 38 to assist in the opening and closing of the cabinet 10, and a means for securing the cabinet 10 when it is in its open position.

The lifting bar 38 is a metal bar with one end attached to the shelf 34 by a U-shaped clamp enabling the lifting bar 38 to pivot about that attachment point. The shelf 34 also contains a securing aperture 37 generally located so the free end of the lifting bar 38 can be temporarily secured within the securing aperture 37 when the cabinet 10 is in the open position and the lifting bar 38 is not in use. A clip 49 is also located on the shelf 34 directly above the U-shaped clamp enabling the lifting bar 38 to be secured to the shelf 34 in a horizontal position when the cabinet 10 is in the closed position.

Figure 5:
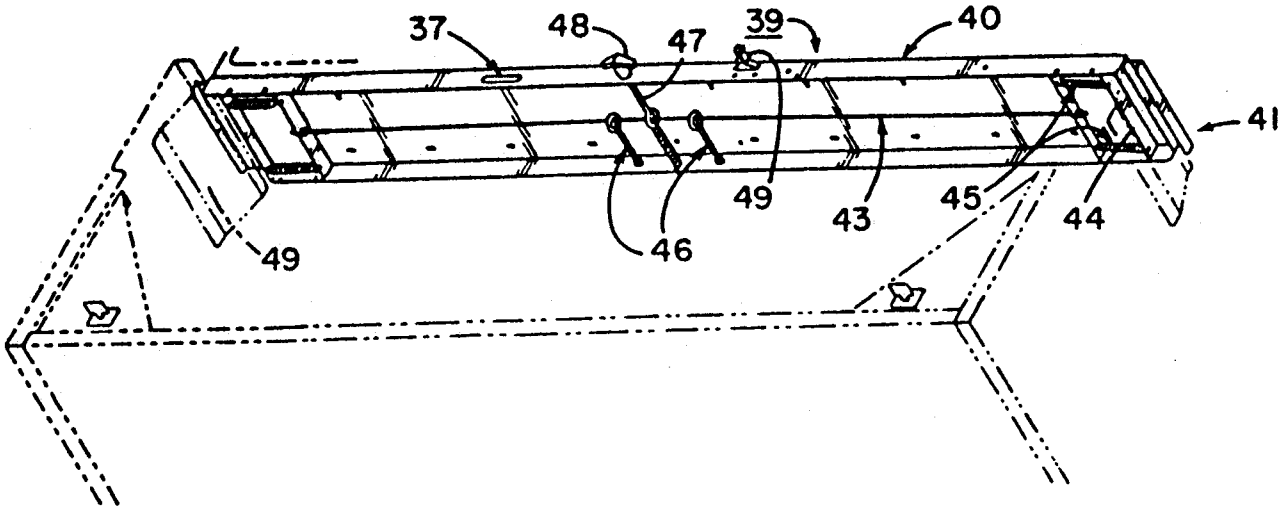
FIG. 5 is a perspective view, viewed generally from below, of the preferred embodiment shown in FIG. 1 of the securing means for supporting the upper section when it is in the open position.
Figure 6:
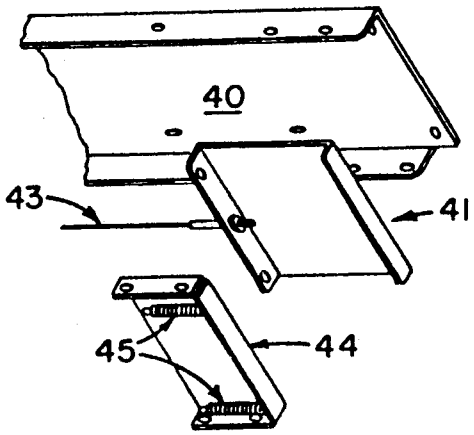
FIG. 6 is a blown apart view of the right end of the securing means shown in FIG. 5.

While many securing means could be used, the preferred embodiment uses a spring loaded retractable flange unit 39, shown most clearly in FIGS. 5 and 6, that is attached to the bottom of the shelf 34. The unit is comprised of a channel member 40 generally equal in length to the length of the shelf 34; two spring loaded retractable flanges 41 connected by a cable 43, generally located within the channel member 40 and generally of an elongated "U-type" shape with the sides of the "U" extending downward toward the lower section 11 and whereby the outer sides align with matching slots 42 in the top edge of lower section first and second end portions 12, 13; and two end brackets 44 generally located within the retractable flange 41, and attached to the channel member 40. Springs 45 are then attached between the end brackets 44 and retractable flanges 41. The cable 43 passes through two generally centrally located fixed eye-bolts 46, and a movable eye-bolt 47 attached to a release handle 48 extending out of the shelf 34 and generally located between the two fixed eye-bolts 46.

As the release handle 48 on the movable eye-bolt 47 is pulled toward the user, the retractable flanges 41 are pulled inward by the cable 43 to a position where they are within the space defined by the inside surfaces of the lower section first and second ends 12, 13 and the springs 45 are stretched. When the release handle 48 is released, the springs 45 return the retractable flanges 41 to the position aligning with the slots 42 in the lower section first and second ends 12, 13. In addition, a deflecting plate 49 is generally located on the interior side of lower section first and second ends 12, 13 with the top of the deflector plates 49 being at the same height as the top of the lower section first and second ends 12, 13. The deflector plates 49 also taper into the space between lower section first and second ends 12, 13 as they extend from their bottom toward their top.

When the cabinet 10 is moved from its closed to its open position, the locking means is released and the flap portion 22 is pulled upward and over the fixed portion 21 until the steel strips 51 make contact with the magnets 50, thereby securing the flap portion 22 to the fixed portion 21. The user can then reach inside the cabinet 10, grab and pull the lifting bar 38 to rotate the upper section 16 out of the lower section 11, as shown in FIG. 7. As the lifting bar 38 is pulled upward, the upper section 16 will rotate about the piano type hinge and out of the lower section 11 as shown in FIG. 7.

As the upper section 16 continues to rotate out of the lower section 11, the retractable flanges 41 will be forced inward by the taper in the deflecting plates 49. When the upper section 16 has been rotated to just above a horizontal plane, the retractable flanges 41 will clear the deflector plates 49 and extend to a position aligning with the slots 42. The upper section 16 is then lowered allowing the retractable flanges 41 to enter the matching slots 42 in the lower section first and second end portions 12, 13 thereby securing the upper section 16 in the open position as shown in FIG. 1. Moreover, the retractable flange unit 39 will also rest on the deflecting plates 49, providing more support.

When closing the unit, the lifting bar 38 is removed from the securing aperture 37, rotated into a vertical position. The lifting bar is then used to pull the upper section 16 upward until the retractable flanges 41 have cleared the slots 42. The release handle 48 is then pulled toward the user until the retractable flanges 41 have moved to a position inside the space defined between the deflecting plates 49. The upper section 16 can then be lowered into the lower section 11. Once the retractable flanges 41 have been lowered beyond the top of the deflecting plates 49, the release handle 48 can be released. When the upper section 16 is fully lowered, the lifting bar 38 will remain secured in the clip 49 to assure its easy access for opening the cabinet 10 at a later time and the flap portion 22 is lowered and locked.

A stopping means could also be incorporated into the cabinet 10 to prevent the operator from overrotating the upper section 16 when moving the cabinet 10 between the open and closed positions. One such means would be to attach flanges to the bottom of shelf 34 near lower section first and second end portions 12, 13. The flanges would extend downward for a length slightly greater than the length needed to allow the upper section 16 to rotate above the horizontal plane to enable the retractable flanges 41 to extend. The flanges would then extend outward for a length that is small enough to enable the flange to rotate within the space defined between the lower section first and second end portions 12, 13, but long enough to prevent the flange from rotating above the top edge of first or second end portions 12, 13. Those skilled in the art would appreciate that other stopping means could be used.

Figure 4:
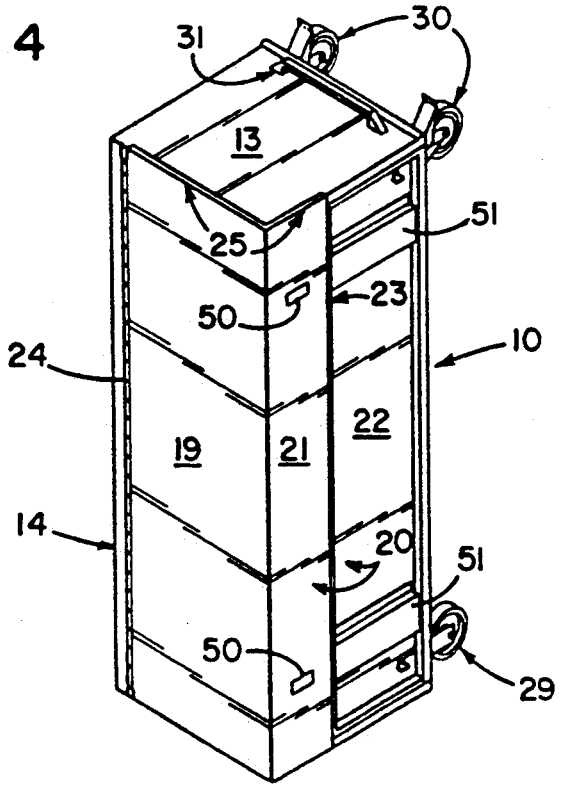
FIG. 4 is a perspective view of the preferred embodiment shown in FIG. 1 in a closed position and showing a vertical storage position.

To improve the mobility of the cabinet 10, four casters are attached to the lower section bottom portion 15. Two fixed casters 29 are located near the lower section first end portion 12 and two locking brake swivel casters 30, as shown in FIG. 4, are located near the lower section second end portion 13. This arrangement allows the cabinet 10 to be rolled or fixed in a stationary position.

Mobility is also improved by the attachment of a handle 31 to the lower section second end portion 13, as shown in FIG. 4. The handle 31 is used to elevate the lower section second end portion 13 enabling the cabinet 10 to be moved in a cart-like fashion. Moving the cabinet 10 in this fashion effectively shortens its length improving its mobility through doorways or around corners.

The handle 31 can also be used to rotate the cabinet 10 to a vertical storing position, FIG. 4. To protect the cabinet 10 when it is stored in its vertical position, four rubber bumpers 32 are generally located in the corners of lower section first end portion 12. The cabinet 10 rests on the bumpers 32 when stored in the vertical position, thereby protecting the finish on the unit.

Although characteristics and advantages, together with details for structure, materials, function and process steps, have been described in reference to a preferred embodiment herein, it is understood that the disclosure is illustrative. To that degree, various changes made, especially to matters of shape, size and arrangement, to the full extent extended by the general meaning of the terms in which the appended claims are expressed, are within the principles of the present invention.

What is claimed is:

1. A portable folding cabinet with open and closed positions comprising:

a. a lower section having first and second end portions, a front portion and a bottom portion;

b. an upper section having first and second end portions with heights generally less than or equal to the width of said lower section first and second end portions, a front portion having a suitable size and shape to be compatible with said lower section bottom portion, and a top portion having a suitable size and shape to be compatible with said lower section front portion, said top portion comprising a fixed portion attached to said upper section front portion and said upper section first and second end portions, and a flap portion having a width generally greater than said fixed portion and pivotably attached to said fixed portion by hinging means to enable said flap portion to fold upward and lay on top of said fixed portion;

c. a hinging means for pivotably attaching a bottom of said upper section to a top of said lower section front portion to enable said upper section to move from open to closed positions;

d. a supporting means for securing said upper section to said lower section when the cabinet is in its open position; and e. a hauling means attached to either said upper section or said lower section.

2. A portable folding cabinet as in claim 1, wherein said hauling means consists of a rolling means on said lower section bottom portion and a handle on one end portion of said upper section or said lower section.

3. A portable folding cabinet as in claim 2, wherein said rolling means is a plurality of casters.

4. A portable folding cabinet as in claim 1, further comprising a locking means for securing said upper section to said lower section when the cabinet is in its closed position.

5. A portable folding cabinet as in claim 1, wherein said supporting means is one or more spring loaded retractable flanges attached to said upper section that move between a first position wherein they are located within the space defined between said lower section first and second end portions and a second position wherein they extend outward from said upper section first and second end portions and aligning with matching slots located in said lower section first and second end portions.

6. A portable folding cabinet as in claim 1, further comprising a lifting means for use in moving the cabinet between the open to closed positions.

7. A portable folding cabinet as in claim 6, wherein said lifting means comprises a lifting bar with one end attached to said upper section by a "U-shaped" clamp to enable said lifting bar to pivot about the attachment point and a means for securing the free end of said lifting bar to said upper section when said lifting bar is not in use.

8. A portable folding cabinet with open and closed positions comprising:

a. a lower section having first and second end portions, a front portion and a bottom portion;

b. an upper section having first and second end portions with heights generally less than or equal to the width of said lower section first and second end portions, a front portion having a suitable size and shape to be compatible with said lower section bottom portion, and a top portion generally equal in size and shape to said lower section front portion, said top portion comprising a fixed portion attached to said upper section front portion and said upper section first and second end portions, and a flap portion having a width generally greater than said fixed portion and pivotably attached to said fixed portion by hinging means to enable said flap to fold upward to lay on top of said fixed portion;

c. a shelf generally located in an interior space of and attached to either said upper section or said lower section and having a width less than or equal to the height of said lower section front portion;

d. a hinging means for pivotably attaching a portion of said upper section front portion to a top of said lower section front portion to enable said upper section to move between open and closed positions;

e. a supporting means for securing said upper section to said lower section when the cabinet is in its open position; and f. a hauling means attached to either said upper section or said lower section.

9. A portable folding cabinet as in claim 8, wherein said shelf is located at a bottom of said upper section and attached to said upper section front and said upper section first and second end portions.

10. A portable folding cabinet as in claim 8, further comprising an insulated bin attached to said shelf.

11. A portable folding cabinet as in claim 8, further comprising a speed rail and a means for attaching said speed rail to said shelf.

12. A portable folding cabinet as in claim 8, wherein said hauling means consists of a rolling means on said lower section bottom portion and a handle on one end portion of said upper section or said lower section.

13. A portable folding cabinet as in claim 12, wherein said rolling means is a plurality of casters.

14. A portable folding cabinet as in claim 8, wherein said supporting means is one or more spring loaded retractable flanges attached to said upper section that move between a first position wherein said retractable flanges are generally located within the space defined between the lower section first and second end portions and a second position wherein said retractable flanges extend outward from said upper section first and second end portions to align with matching slots located in said lower section first and second end portions.

15. A portable folding cabinet as in claim 9, further comprising a lifting means for use in moving the cabinet between open and closed positions.

16. A portable folding cabinet as in claim 15, wherein said lifting means comprises a lifting bar with one end attached to said shelf by a "U-shaped" clamp to enable said lifting bar to pivot about the attachment point and a means for securing the other end of said lifting bar to said shelf when said lifting bar is not in use.

17. A portable folding cabinet with open and closed positions comprising:

a. a lower section having first and second end portions, a front portion and a bottom portion;

b. an upper section having first and second end portions generally located within a space defined between said lower section first and second end portions when the cabinet is in the closed position and equal in height to the width of said lower section first and second end portions, a front portion generally equal in size and shape to said lower section bottom portion having terminal flanges extending from ends of said front portion at a right angle toward said lower section first and second end portions, a top portion generally equal in size and shape to said lower section front portion comprised of a fixed portion attached to said upper section first and second end portions and having terminal flanges extending from ends of said fixed portion at a right angle toward said lower section first and second end portions and a flap portion generally greater in width than said fixed portion and pivotably attached to said fixed portion by a hinge to enable said flap portion to fold upward to lay on top of said fixed portion;

c. a shelf generally located at the bottom of and attached to said upper section front portion and said upper section first and second end portions with a width less than or equal to the height of said lower section front portion and further comprising an insulated bin and means for attaching a speedrail;

d. a hinging means for pivotably attaching the bottom of said upper section front portion to the top of said lower section front portion to enable said upper section to move from open to closed positions;

e. a locking means for securing said upper section to said lower section when the cabinet is in its closed position;

f. a plurality of spring loaded retractable flanges attached to said upper section that move between a first position wherein said retractable flanges are generally located within the space defined between said lower section first and second end portions and a second position wherein said retractable flanges extend outward of said upper section first and second end portions to align with matching slots located in said lower section first and second end portions, thereby securing said upper section to said lower section while the cabinet is in the open position;

g. a plurality of casters attached to the bottom of said lower section;

h. a handle generally located on either said lower section first end portion or said lower section second end portion;

i. a bumper means generally located on said lower section end portion without said handle; and j. a lifting bar with one end attached to said shelf by a "U-shaped" clamp to enable said lifting bar to pivot about the attachment point and a means for securing said lifting bar to said shelf when said lifting bar is not in use.

18. A portable folding cabinet as in claim 17, wherein said upper and lower sections are made of aluminum with a vinyl metal laminate.

19. A portable folding cabinet as in claim 17, wherein said shelf is made of stainless steel.

20. A portable folding cabinet as in claim 17, wherein said plurality of casters comprises two fixed casters, one generally located near each corner of said lower section bottom portion nearest to said lower section end portion with said bumper means and two locking brake and swivel casters, one generally located near each corner of said lower section bottom portion nearest to said lower section end portion with said handle.

21. A portable folding cabinet as in claim 17, wherein said bumper means is comprised of a plurality of rubber frusta-conical members attached to said lower section end portion.

22. A portable folding cabinet as in claim 17, wherein said hinging means between said upper section and said lower section is a piano-type hinge.

23. A portable folding cabinet as in claim 17, wherein said locking means is comprised of two rotating flanges, one mounted on a triangular brace attached to said lower section bottom portion and said lower section first end portion and the second mounted on a triangular base attached to said lower section bottom portion and said lower section second end portion whereby said rotating flanges extend outward from the back of the cabinet, and two apertures in said flap portion arranged and configured with generally the same width and thickness as said rotating flanges and located to align with said rotating flanges when the cabinet is in its closed position.

* * * * *